US006489866B1

(12) United States Patent
Uchida et al.

(10) Patent No.: US 6,489,866 B1
(45) Date of Patent: Dec. 3, 2002

(54) MICROWAVE MODULE

(75) Inventors: Hiromitsu Uchida; Yasushi Itoh, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 63 days.

(21) Appl. No.: 09/637,833

(22) Filed: Aug. 11, 2000

Related U.S. Application Data

(63) Continuation of application No. PCT/JP00/00571, filed on Feb. 2, 2000.

(30) Foreign Application Priority Data

Apr. 26, 1999 (JP) ..... 11-118262

(51) Int. Cl.[7] ..... H01P 5/00
(52) U.S. Cl. ..... 333/247; 333/246
(58) Field of Search ..... 333/33, 247, 246

(56) References Cited

U.S. PATENT DOCUMENTS 5,422,609 A * 6/1995 Ho et al. ..... 333/33 X
5,428,327 A * 6/1995 Bahl ..... 333/247 X
5,550,518 A * 8/1996 Mohwinkel ..... 333/33

FOREIGN PATENT DOCUMENTS

| | | |
|---|---|---|
| JP | 64-25500 | 1/1989 |
| JP | 2-165510 | 6/1990 |
| JP | 8-111605 | 4/1996 |

* cited by examiner

*Primary Examiner*—Benny Lee
(74) *Attorney, Agent, or Firm*—Oblon, Spivak, McClelland, Maier & Neustadt, P.C.

(57) ABSTRACT

In a microwave module including a transmitting portion circuit and a receiving portion circuit, the transmitting portion circuit and the receiving portion circuit are respectively constructed by transmission lines of different kinds in which polarization planes are orthogonal to each other, and are constructed on the same surface of the same substrate. For example, one of the transmitting portion circuit and the receiving portion circuit is constructed by a microstrip line, and the other is constructed by a coplanar line. Further, one of the transmitting portion circuit and the receiving portion circuit is constructed by a microstrip line, and the other is constructed by a slot line. By this, there is obtained a microwave module in which mutual interference by an electromagnetic field between element circuits in the module can be suppressed, the circuits can be arranged close to each other without requiring a shielding member, and miniaturization of the module can be realized.

3 Claims, 4 Drawing Sheets

MICROWAVE MODULE

CROSS REFERENCE TO RELATED APPLICATION

This is a continuation of International Application PCT/JP00/00571, with an international filing date of Feb. 2, 2000.

TECHNICAL FIELD

The present invention relates to a microwave module in which a transmitting portion circuit and a receiving portion circuit are integrated.

BACKGROUND ART

In order to suppress mutual interference between a transmitting portion circuit and a receiving portion circuit included in a microwave module, there has been adopted such means that the respective circuits are constructed with different substrates and a shielding member made of a metal plate or electric wave absorber is provided between both, or the distance between the substrates is made large.

FIG. 4 is a structural view of a microwave module disclosed in Japanese Patent Unexamined Publication No. Sho. 64-25500.

In FIG. 4, reference numeral 50 designates an FET (field-effect transistor); reference numerals 51 and 52, circuits made of microstrip lines; reference numeral 53, a shielding member such as an electric wave absorber; and reference numeral 54, a cut into which the shielding member 53 is fitted.

In the microwave module having the structure shown in FIG. 4, in order to prevent mutual interference by an electromagnetic field between the circuits 51 and 52 provided in a housing of the microwave module, the shielding member 53 is provided along the cut 54, so that isolation between the circuits is raised.

As described above, in the conventional microwave module, in order to suppress the mutual interference by the electromagnetic field between the transmitting and receiving circuits in the microwave transmitting and receiving module, the respective circuits are constructed on different substrates, and further, the shielding member made of the metal or electric wave absorber is provided between both. However, in that case, the size and weight of the module is large.

The present invention has been made to solve the foregoing problem, and has an object to provide a microwave module in which mutual interference by an electromagnetic field between element circuits in the module can be suppressed, and the circuits can be arranged close to each other without requiring a shielding member, so that miniaturization of the module can be realized.

SUMMARY OF THE INVENTION

A microwave module of the present invention comprises a transmitting portion circuit and a receiving portion circuit, wherein the transmitting portion circuit and the receiving portion circuit are respectively constructed by transmission lines of different kinds in which polarization planes are orthogonal to each other, and are constructed on the same surface of the same substrate.

Further, one of the transmitting portion circuit and the receiving portion circuit is constructed by a microstrip line, and the other is constructed by a coplanar line.

Furthermore, one of the transmitting portion circuit and the receiving portion circuit is constructed by a microstrip line, and the other is constructed by a slot line.

BEST MODE FOR CARRYING OUT THE INVENTION

Embodiment 1

Figure 1:
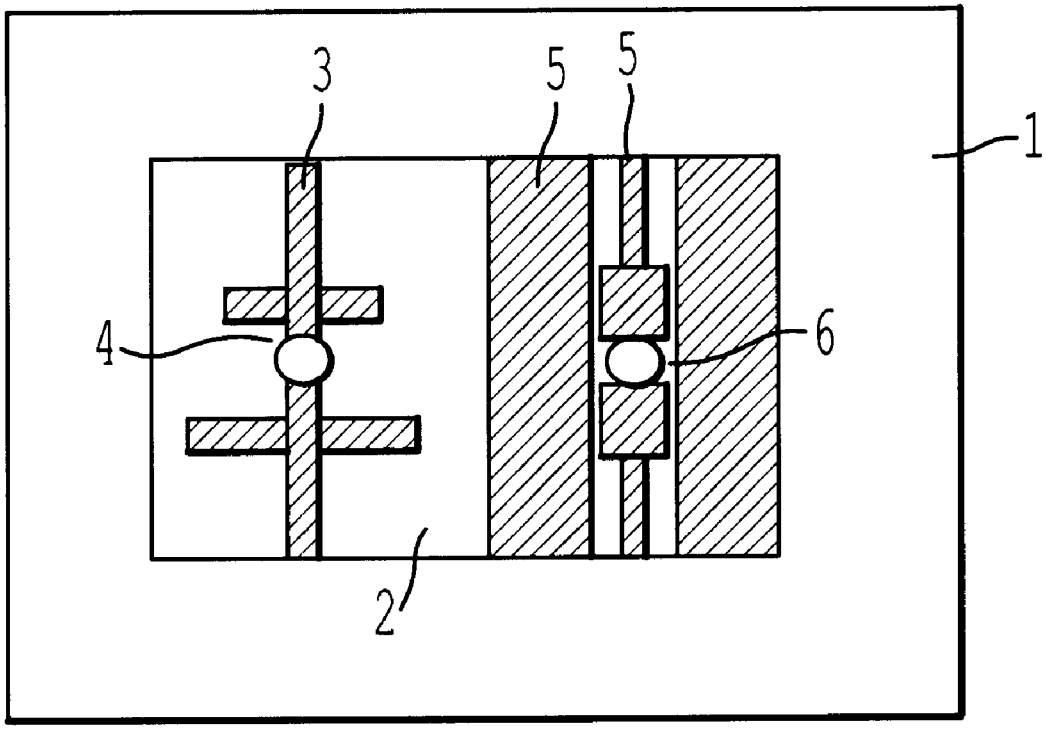
FIG. 1 is a structural view showing a microwave module of embodiment 1of the present invention.

FIG. 1 is a structural view showing a microwave module of embodiment 1 of the present invention.

In the drawing, reference numeral 1 designates a housing of a module; and reference numeral 2, a dielectric substrate, the rear surface of which is covered with a metal conductor. Reference numeral 3 designates a conductor pattern which, together with the dielectric circuit 2, constitutes a microstrip line, and which, together with an active element 4 of a transmitting portion circuit, constitutes the transmitting portion circuit. Reference numeral 5 designates a conductor pattern constituting a coplanar line, and, together with an active element 6 of a receiving portion circuit, constitutes the receiving portion circuit.

Next, the operation will be described with reference to FIG. 2.

Figure 2A:
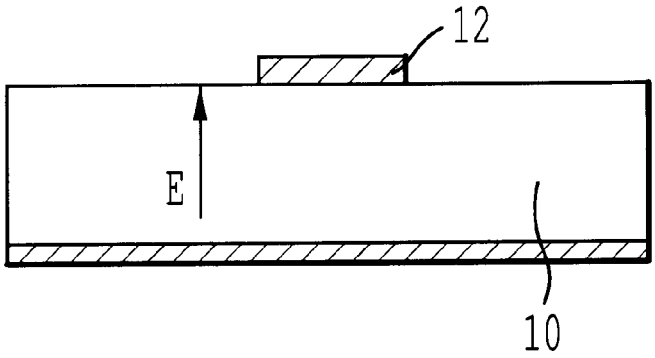
FIG. 2 shows a direction of an electric field of each of a microstrip line and a coplanar line.
Figure 2B:
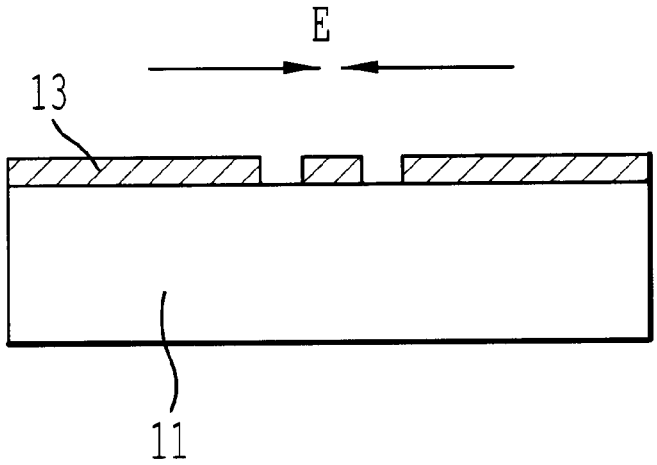

FIG. 2 shows a direction of an electric field of each of a microstrip line and a coplanar line.

In the drawing, reference numerals 10 and 11 designate dielectric substrates; and reference numerals 12 and 13, conductor patterns. The microstrip line is constituted by the dielectric substrate 10 and the conductor pattern 12, and the coplanar line is constituted by the dielectric substrate 11 and the conductor pattern 13. As shown by arrows in the drawing, since the directions of electric fields in the respective lines are orthogonal to each other, it is possible to suppress interference by an electromagnetic field generated between both.

As described above, according to the structure of the embodiment 1, one of the transmitting and receiving circuits in the microwave module is constructed by the microstrip line, the other is constructed by the coplanar line, and both are constructed on the same surface of the same substrate, so that the mutual interference by the electromagnetic field between the transmitting portion circuit and the receiving portion circuit can be suppressed, and therefore, a shielding member such as a metal wall or electric wave absorber becomes unnecessary, and miniaturization and weight lightening of the microwave module can be realized.

Embodiment 2

Figure 3:
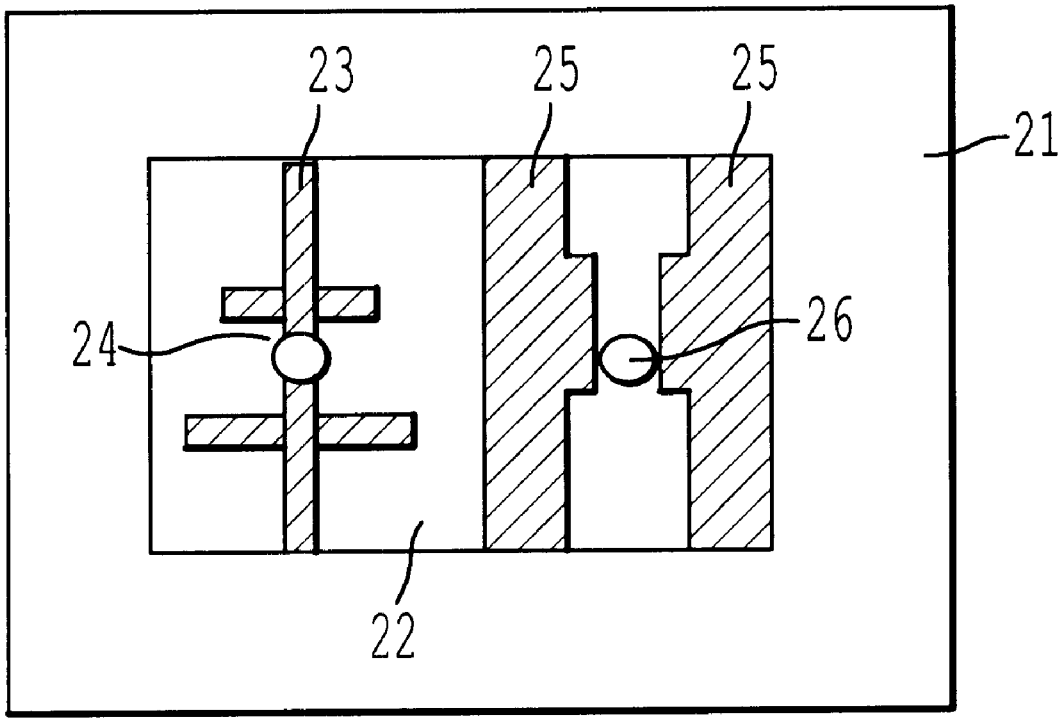
FIG. 3 is a structural view showing a microwave module of embodiment 2 of the present invention.

FIG. 3 is a structural view showing a microwave module of embodiment 2 of the present invention.

In the drawing, reference numeral 21 designates a housing of a module; and reference numeral 22, a dielectric substrate the rear surface of which is. covered with a metal conductor. Reference numeral 23 designates a conductor pattern which, together with the dielectric substrate 22, constitutes a microstrip line, and which, together with an active element 24 of a transmitting portion circuit, constitutes the transmitting portion circuit. Reference numeral 25 designates a conductor pattern constituting a slot line which, together with an active element 26 of a receiving portion circuit, constitutes the receiving portion circuit.

Next, the operation will be described.

As compared with the microwave module described in the embodiment 1, this microwave module is different from embodiment 1 in that the slot line is used instead of the coplanar line. Since the direction of an electric field of the slot line is also orthogonal to that of the microstrip line, the interference by an electromagnetic field generated between both can be suppressed.

As described above, according to the structure of the embodiment 2, one of the transmitting and receiving circuits in the microwave module is constructed by the microstrip line, the other is constituted by the slot line, and both are constructed on the same surface of the same substrate, so that the mutual interference by the electromagnetic field between the transmitting portion circuit and the receiving portion circuit can be suppressed; and therefore, a shielding member such as a metal wall or electric wave absorber becomes unnecessary, and miniaturization and weight reduction of the microwave module can be realized.

INDUSTRIAL APPLICABILITY

As described above, according to the present invention, in a microwave transmitting. and receiving module including a transmitting portion circuit and a receiving portion circuit, the transmitting portion circuit and the receiving portion circuit are respectively constructed by transmission lines of different kinds in which polarization planes are orthogonal to each other, and are constructed on the same surface of the same substrate, so that mutual interference by an electromagnetic field between element circuits in the module can be suppressed, and the circuits can be arranged close to each other without requiring a shielding member, and by this, miniaturization of the module can be realized.

What is claimed is:

1. A microwave module comprising:

a first portion comprising at least one active component interconnected by a plurality of transmission lines of a first type having a first polarization plane and constructed on a surface of a substrate; and a second portion comprising at least one active component interconnected by a plurality of transmission lines of a second type having a second polarization plane and constructed on said surface of said substrate;

wherein said first portion and said second portion are separated electrically;

wherein said first portion comprises a receiving circuit and said second portion comprises a transmitting circuit; and wherein said first polarization plane and said second polarization plane are substantially orthogonal.

2. The microwave module as set forth in claim 1, wherein said plurality of transmission lines of a first type are microstrip lines, and said plurality of transmission lines of a second type are coplanar lines.

3. The microwave module as set forth in claim 1, wherein said plurality of transmission lines of a first type are microstrip lines, and said plurality of transmission lines of a second type are slot lines.

* * * * *

UNITED STATES PATENT AND TRADEMARK OFFICE

CERTIFICATE OF CORRECTION

PATENT NO. : 6,489,866 B1
DATED : December 3, 2002
INVENTOR(S) : Hiromitsu Uchida et al.

Figure 4:
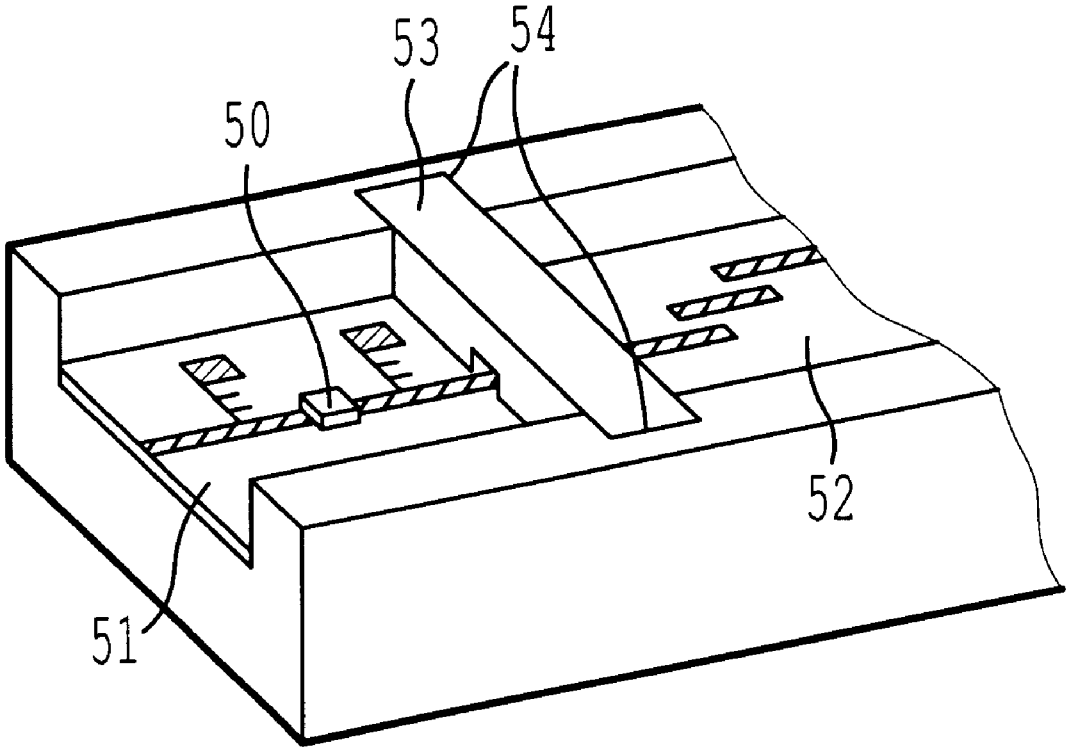
FIG. 4 is a structural view of a microwave module disclosed in Japanese Patent Unexamined Publication No. Sho. 64-25500.
Figure 4:
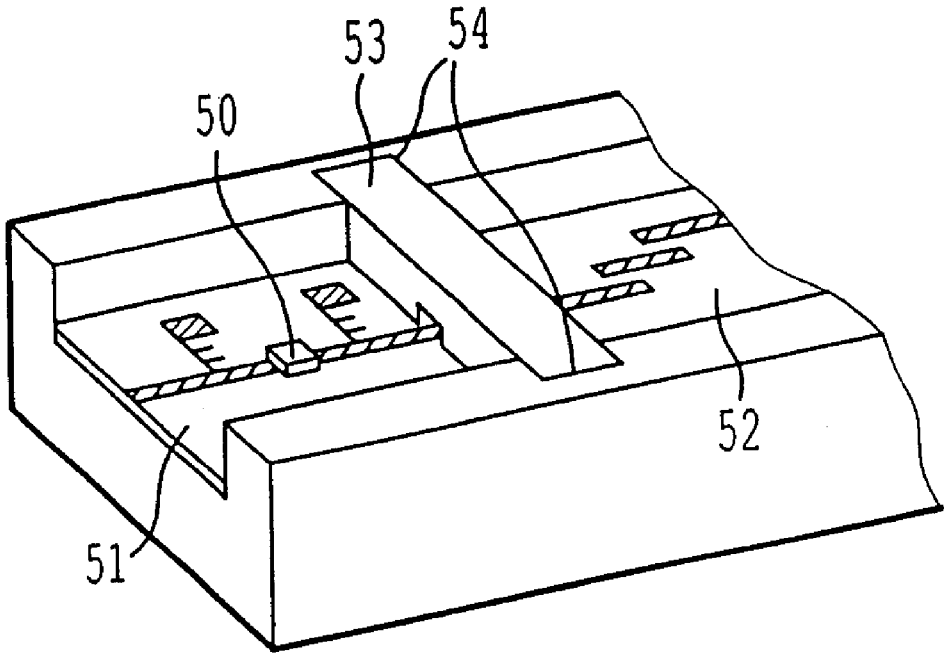
FIG. 4 BACKGROUND ART

It is certified that error appears in the above-identified patent and that said Letters Patent is hereby corrected as shown below:

Drawings,
Please replace Figure 4 with the attached substitute sheet for Figure 4 to include the labeling of Figure 4 as Background Art.

Signed and Sealed this

Ninth Day of September, 2003

JAMES E. ROGAN
*Director of the United States Patent and Trademark Office*